US012710174B2

(12) United States Patent
Nilsen et al.

(10) Patent No.: US 12,710,174 B2
(45) Date of Patent: Aug. 18, 2026

(54) CHAR COLLECTOR

(71) Applicant: Scanship AS, Tonsberg (NO)

(72) Inventors: Pal Jahre Nilsen, Bodalen (NO); Per Langoy, Solbergmoen (NO); Joachim Oelschlagel, Heggedal (NO); Odd Egil Solheim, Hvalstad (NO); Svein Gåsbak, Moss (NO)

(73) Assignee: Scanship AS, Tønsberg (NO)

( * ) Notice: Subject to any disclaimer, the term of this patent is extended or adjusted under 35 U.S.C. 154(b) by 596 days.

(21) Appl. No.: 18/268,250

(22) PCT Filed: Nov. 29, 2021

(86) PCT No.: PCT/EP2021/083334
§ 371 (c)(1),
(2) Date: Jun. 19, 2023

(87) PCT Pub. No.: WO2022/135838
PCT Pub. Date: Jun. 30, 2022

(65) Prior Publication Data

US 2024/0053005 A1 Feb. 15, 2024

(30) Foreign Application Priority Data

Dec. 21, 2020 (NO) ..... 20201414

(51) Int. Cl.
*F23J 1/02* (2006.01)
*F23J 1/06* (2006.01)

(52) U.S. Cl.
CPC . *F23J 1/02* (2013.01); *F23J 1/06* (2013.01); *F23J 2700/001* (2013.01)

(58) Field of Classification Search
CPC .. F23J 1/02; F23J 1/06; F23J 2700/001; F23J 2219/80; F23J 2900/00; F23J 2900/01005;

(Continued)

(56) References Cited

U.S. PATENT DOCUMENTS 3,589,317 A * 6/1971 Kunovits ..... F23J 1/00 110/342
3,729,105 A * 4/1973 Huebler ..... B65G 53/4691 414/221

(Continued)

FOREIGN PATENT DOCUMENTS

CN 103923673 7/2014
CN 105062527 11/2015

(Continued)

OTHER PUBLICATIONS

Statement of Relevance: CN103923673A discloses a similar solution as in U.S. Pat. No. 5,387,321.

(Continued)

*Primary Examiner* — David J Laux
(74) *Attorney, Agent, or Firm* — Christian D. Abel

(57) ABSTRACT

The present invention provides a char collector (1) for a pyrolysis system (2), the pyrolysis system (2) featuring a pyrolysis reactor (17) comprising a hot char outlet (3), the char collector comprises a container (4) and a longitudinal char conveyor unit (5), and—the container (4) comprises a chamber (6), a first inlet (7) connectable to the hot char outlet (3) and a first outlet (8), wherein the first inlet (7) is arranged in an upper portion of the chamber (6) and the first outlet (8) is arranged in a lower portion of the chamber (6); and—the char conveyor unit (5) comprises a first end section (9) connected to the first outlet (8), a second end section (10) featuring a second outlet (11) for cooled char and a conveying mechanism (12) configured to transport char from the first end section (9) to the second outlet (11) during use; wherein the second outlet (11) is at a level above the first outlet (8), such that a gas trap is formed between the first inlet (7) and the second outlet (11) when the chamber (6) is (Continued)

filled with water up to a level above the first outlet (8) during use.

12 Claims, 6 Drawing Sheets

(58) Field of Classification Search
CPC .... F23J 2900/01006; F23J 2900/01007; C10B 39/04
See application file for complete search history.

(56) References Cited

U.S. PATENT DOCUMENTS

| | | | | |
|---|---|---|---|---|
| 4,126,519 | A | 11/1978 | Murray | |
| 4,301,746 | A * | 11/1981 | Pech | F23J 1/02 110/165 R |
| 4,440,097 | A * | 4/1984 | Teske | B65G 23/44 198/810.04 |
| 4,534,299 | A * | 8/1985 | Buchmuller | F23J 1/02 110/165 R |
| 4,557,248 | A * | 12/1985 | Richards | F23B 1/16 110/101 CC |
| 4,695,214 | A * | 9/1987 | Scinta | C10J 3/50 414/217 |
| 5,387,321 | A | 2/1995 | Holland | |
| 5,714,043 | A | 2/1998 | Finley | |
| 6,184,427 | B1 | 2/2001 | Klepfer | |
| 7,743,912 | B2 * | 6/2010 | Finley | C10B 53/07 198/666 |
| 2004/0231243 | A1 * | 11/2004 | Goke | C10K 3/023 48/209 |
| 2011/0226194 | A1 * | 9/2011 | Mooney | F23J 1/02 122/396 |
| 2012/0043194 | A1 | 2/2012 | Lepez | |
| 2019/0256354 | A1 | 8/2019 | Lepez | |

FOREIGN PATENT DOCUMENTS

| | | | | |
|---|---|---|---|---|
| CN | 108329950 | A | 7/2018 | |
| EP | 0065850 | | 12/1982 | |
| EP | 0913360 | | 5/1999 | |
| EP | 2014744 | | 1/2009 | |
| EP | 2537912 | | 12/2012 | |
| EP | 2537912 | A1 * | 12/2012 | C10J 3/36 |
| GB | 189418879 | | 5/1895 | |
| JP | 2004292550 | | 10/2004 | |
| JP | 2007246683 | | 9/2007 | |
| WO | 2018/177997 | | 10/2018 | |

OTHER PUBLICATIONS

Lam, et al., "A Review on Waste to Energy Processes Using Microwave Pyrolysis" Energies, 2012, 5, 4209-4232.

ISRWO dated Mar. 7, 2022, filed inter alia as a statement of relevance for any non-English refs cited therein.

NOSR in Application NO20201414, filed inter alia as a statement of relevance for any non-English refs cited therein.

"Daily Chemical Machinery and Equipment", Liang, Yaokai, et al. China Light Industry Press, pp. 53-58, May 2000.

Translation of Office Action from Japan Patent Office in JP2023-536876, submitted inter alia as a Statement of Relevance for any non-English references cited therein.

Translation of Office Action from China Patent Office in CN2021800864079 dated Nov. 13, 2025, submitted inter alia as a Statement of Relevance for any non-English references cited therein (including npl 1 above).

P27705CNPC_OA1_summarized English translation with search report, submitted inter alia as a statement of relevance for any non-English references cited therein.

* cited by examiner

CHAR COLLECTOR

TECHNICAL FIELD

The present invention relates to the field of pyrolysis systems, and more particularly to a char collector for use in a pyrolysis system.

BACKGROUND

Waste disposal and management off-shore, for instance on ships, is commonly obtained by combining the use of incinerators, collection of waste such as cooking oil, oil sludge, paper, plastics, cardboard and wood pallets for subsequent weekly landing on-shore, as well as the discharge of sewage sludge and food waste to sea. Consequently, the environmental footprint is quite large, especially in areas where the shipping traffic is high. This is especially noticeable in connection with cruise ships, wherein certain ports and ocean regions have numerous legislations prohibiting discharge to sea, as well as flue gas emissions. The latter prohibition applies to ships at port, and thus restricts the use of on-ship incinerators. Many of the same problems and issues regarding waste disposal and management are found in rural areas, islands and similar sites where access to large-scale waste disposal facilities are restricted.

In addition to common incinerators, pyrolysis systems have also been used in waste disposal systems and processes for conversion of biomass. Pyrolysis is a thermochemical decomposition of organic material at elevated temperatures in the absence of oxygen, and in these systems, the pyrolysis reaction is obtained by an internal plasma arc or an external heating. The advantage of using a pyrolysis reactor instead of an incinerator is the low environmental impact in terms of air pollution and discharge of residues. In addition to char, the pyrolysis reactor produces syngas and/or bio oil, which may be used for fueling a boiler and/or a gas turbine to produce energy as heat or electric power. Although the known waste disposal systems, using such pyrolysis reactors, are in many ways superior to the systems using incinerators, there still remains a large potential for improvement.

An efficient pyrolysis reactor featuring a heated screw conveyor is disclosed in US 2012/0043194 A1.

A recent development in the art of pyrolysis is the microwave-assisted pyrolysis reactor. In these reactors, microwaves are used to heat the material to be pyrolyzed.

Waste disposal systems using microwave reactors for microwave-assisted pyrolysis are known. Examples of such systems are disclosed in for instance U.S. Pat. Nos. 5,387,321 A and 6,184,427 B1. The physical principles, effects and advantages of using microwave-assisted pyrolysis in waste disposal and waste to energy applications are reviewed by Lam et al. *Energies* 2012, 5, 4209-4232.

The two main products of a pyrolysis reaction are solid char and a fluid consisting of syngas and/or tar/oil.

The produced char is a valuable product that may be used in e.g. soil improvement, as a filtration media and as fuel.

However, collection of the produced char is not straight forward since the char exiting a pyrolysis reactor has a very high temperature and a significant portion of the char may be finely divided particles and fines. Thus, even if the char is cooled it is not trivial to handle due to the fines being highly flammable and may spontaneously combust when mixed with oxygen/air.

In U.S. Pat. No. 5,387,321 A the produced char is introduced to a carbon cooler before being collected via a mechanical air lock. A similar solution is disclosed in CN103923673A.

In U.S. Pat. No. 6,184,427 B1 the produced char is removed from the bottom of a pyrolysis reactor by a screw conveyor.

WO 2018/177997 A1 discloses a pyrolysis system, wherein the produced char is removed from a pyrolysis reactor via screw conveyor provided with an airlock at both ends.

US 2019256354 A1 discloses a pyrolysis system, wherein the produced char is removed from a pyrolysis reactor via an airlock connected to a cooled screw conveyor.

Possible disadvantages of the prior art char collectors are the presence of mechanical airlocks, the output and handling of finely divided char particles, as well as inefficient cooling of the char.

The goal of the present invention is to provide a char collector for pyrolysis systems. In particular, the present invention provides an improved char collector which alleviates or avoids at least some of the disadvantages of the char collectors known in prior art pyrolysis systems.

SUMMARY OF THE INVENTION

The present invention is defined by the appended claims and in the following:

In a first aspect, the present invention provides a char collector for a pyrolysis system, the pyrolysis system featuring a pyrolysis reactor comprising a hot char outlet, the char collector comprises a container and a longitudinal char conveyor unit, and the container comprises a chamber, a first inlet connectable to the hot char outlet and a first outlet, wherein the first inlet is arranged in an upper portion of the chamber and the first outlet is arranged in a lower portion of the chamber; and the char conveyor unit comprises a first end section connected to the first outlet, a second end section featuring a second outlet for cooled char and a conveying mechanism configured to transport char from the first end section to the second outlet during use;

wherein the second outlet is at a level above the first outlet, such that a gas trap is formed between the first inlet and the second outlet when the chamber is filled with water up to a level above the first outlet during use.

In other words, a lowest level of the second outlet may be above a highest level of the first outlet, such that a gas trap is formed between the first inlet and the second outlet when the chamber is filled with water up to a level above the highest level of the first outlet during use.

In other words, the char collector comprises a water fillable section arranged between the first inlet and the second outlet, the section may be configured to prevent gas from passing between the first inlet and the second outlet. The section may comprise a lower portion of the chamber and a lower portion of the char conveyor unit.

In other words, the char collector comprises a water fillable char transfer section arranged between the first inlet and the second outlet, the char transfer section configured to prevent gas from passing between the first inlet and the second outlet.

The first inlet may be connectable to the hot char outlet such that hot char exiting the hot char outlet during use is introduced to the chamber. Preferably, the hot char is introduced in an upper portion of the chamber. The first inlet may be connectable to the hot char outlet in a fluid tight manner.

In an embodiment, the first outlet is arranged in a lower portion of the chamber to allow char to exit the first outlet by help of gravity.

In other words, the first end section of the char conveyor unit may be connected to the first outlet such that char may enter the first end section via the first outlet, preferably by help of gravity. The first end section may be arranged at a lower level than the second end section, i.e. the char conveyor unit may be vertically inclined.

In other words, the char conveyor unit may be inclined such that the first end section is at a lower level than the second end section.

In an embodiment of the char collector, the lowest level of the second outlet may be above a mid-level of the chamber.

In an embodiment of the char collector, the container may comprise a controllable water inlet for providing water into the chamber and a water level sensor for measuring a water level inside the chamber, the water level sensor connected to the controllable water inlet, such that water is added to the chamber when the water level falls below a predetermined level.

In an embodiment of the char collector, the char conveyor unit may comprise a longitudinal hollow element in which at least a lower section of the conveying mechanism may be arranged. The longitudinal hollow element may surround at least parts of the conveying mechanism and comprises the first end section connected to the first outlet. The longitudinal hollow element may extend at least from the first outlet to the second outlet. The second outlet may be arranged in a downwards facing surface of the char conveyor unit, i.e. in a downwards facing surface of the longitudinal hollow element.

In an embodiment of the char collector, the conveying mechanism is a helical screw and the longitudinal hollow element is a tube element. In other words, the char conveyor unit may be a screw conveyor. The circumference of the screw blade may be arranged at a slight distance to an inner surface of the tube element to improve drainage of excess water back towards the container.

In an embodiment of the char collector, the char conveyor unit comprises a third outlet positioned between the first outlet and the second outlet, and the third outlet is at a level above the first outlet. In other words, a lowest level of the third outlet is above a highest level of the first outlet. The third outlet may be arranged such that gas may be introduced to the char conveyor unit via the second outlet and exit from the char conveyor unit via the third outlet. In alternative embodiments, the char conveyor unit may comprise a belt or chain conveyor arranged within a longitudinal hollow element having a suitable cross-section, e.g. rectangular.

The third outlet may be arranged in an upwards facing surface of the char conveyor unit, i.e. in an upwards facing surface of the longitudinal hollow element. The third outlet may also be termed a vent outlet.

When having a third outlet, the char collector may comprise a water fillable char transfer section arranged between the first inlet and the third outlet, the char transfer section configured to prevent gas from passing between the first inlet and the third outlet.

In an embodiment, the char collector comprises a plate or blade assembly arranged within the chamber and configured to stir or mix the hot char with the water within the chamber during use. The plate or blade assembly may be arranged to allow movement of a plate or blade between an upper position and a lower position, wherein the plate or blade is closer to the first inlet in the upper position than in the lower position.

In an embodiment, the char collector may comprise at least one blade arranged to rotate inside the chamber. The blade may be arranged to rotate such that hot char entering the container via the first inlet is mixed with water inside the container during use. The at least on blade may also be termed a plate element, mixing blade, impeller blade or paddle blade.

In an embodiment of the char collector, the blade may be connected to a rotary shaft arranged to allow rotation of the blade between a first position and a second position, wherein the blade is at a higher level in the first position than in the second position. During use, at least portions of the blade may be above a water level in the container when in the first position and at least portions of the blade may be below the water level when in the second position.

In an embodiment of the char collector, the blade may be closer to the first inlet in the first position than in the second position. The blade may comprise a first end and a second end, wherein the first end is connected to the rotary shaft and the second end is closer to the first inlet in the first position than in the second position.

In an embodiment of the char collector, the blade may be arranged to allow rotation or movement of the blade between an upper position and a lower position, wherein the blade is closer to the first inlet in the upper position than in the lower position.

In an embodiment of the char collector, the chamber may be cylinder-shaped and has a horizontal centreline. In other words, the chamber may be cylinder-shaped and the bases, or the two parallel planes, of the cylinder-shaped chamber are vertical.

In an embodiment of the char collector, a centreline of the rotary shaft may coincide with the centreline of the chamber.

In an embodiment of the char collector, the longitudinal char conveyor unit may comprise an air inlet arranged at a level above the third outlet.

In an embodiment, the char collector may comprise sensors for measuring temperature, moisture and/or air flow, arranged at the second outlet, the third outlet and/or the air inlet.

The sensors may be in communication with a control system for controlling the moisture content and temperature of the char exiting the second outlet during use. The control system may be configured to control a flow of air into the air inlet and/or the second outlet. The control system may be configured to control the speed by which char is conveyed from the first outlet to the second outlet.

In a second aspect, the present invention provides a pyrolysis system comprising a pyrolysis reactor and a char collector according to any embodiment of the first aspect, wherein the pyrolysis reactor comprises a hot char outlet connected to the first inlet of the char collector. The pyrolysis system may for instance be a waste disposal/management system or a biomass conversion system.

In an embodiment of the pyrolysis system, the hot char outlet may be connected to the first inlet by a char transfer assembly.

In a third aspect, the present invention provides a method of collecting char from a pyrolysis reactor having a hot char outlet connected to the first inlet of a char collector according to any of the embodiments of the first aspect, the method comprising the steps of:

providing water into the chamber to obtain a water level above the highest level of the first outlet;

transferring char from the hot char outlet to the chamber;
cooling the char by mixing with the water in the chamber;
transferring the char from the chamber to the second outlet via the first outlet and the char conveyor unit; and
collecting the char from the second outlet.

In an embodiment of the method, the step of collecting the char from the second outlet may comprise loading the char into a fluid tight bag which is subsequently sealed.

In an embodiment, the method may comprise a step of adding water to the chamber as a result of a signal received from a water level sensor or water level switch, the signal indicating that the water level in the chamber is below a predetermined level.

In a fourth aspect, the present invention provides a method of controlling the moisture content of char collected from a pyrolysis reactor having a hot char outlet connected to the first inlet of a char collector according to any of the embodiments of the first aspect, the method comprising the steps of:

introducing a relatively dry and cold air via the air inlet;
extracting a relatively moist and hot air via the third outlet;
determining the temperature and moisture of the char exiting the second outlet; and
increasing the flow of air into the air inlet if the char has a moisture above a predetermined level; or
decreasing the flow of air into the air inlet if the char has a moisture below a predetermined level.

The term "relatively dry and cold" and "relatively moist and hot" is only intended to define the properties of the air flows in the air inlet and the third outlet relative to each other.

In an embodiment of the method according to the fourth aspect, the temperature and optionally the moisture of the char exiting the second outlet may be measured by use of a temperature sensor and a moisture sensor.

In an embodiment of the method according to the fourth aspect, the temperature, moisture and flow of the air into the air inlet may be measured, e.g. by use of a temperature sensor, a moisture sensor and a flow meter.

In an embodiment of the method according to the fourth aspect, the temperature and moisture of the air exiting the third outlet may be measured, e.g. by use of a temperature sensor and a moisture sensor.

In an embodiment of the method according to the fourth aspect, the moisture content of the char exiting the second outlet is determined by use of a moisture sensor or calculated by use of the measured temperature, moisture and flow at the air inlet and the third outlet.

The term "gas trap" is intended to describe a volume of water separating two spaces such that gas is prevented from moving between them.

SHORT DESCRIPTION OF THE DRAWINGS

The present invention is described in detail by reference to the following drawings.

DETAILED DESCRIPTION OF THE INVENTION

Figure 1:
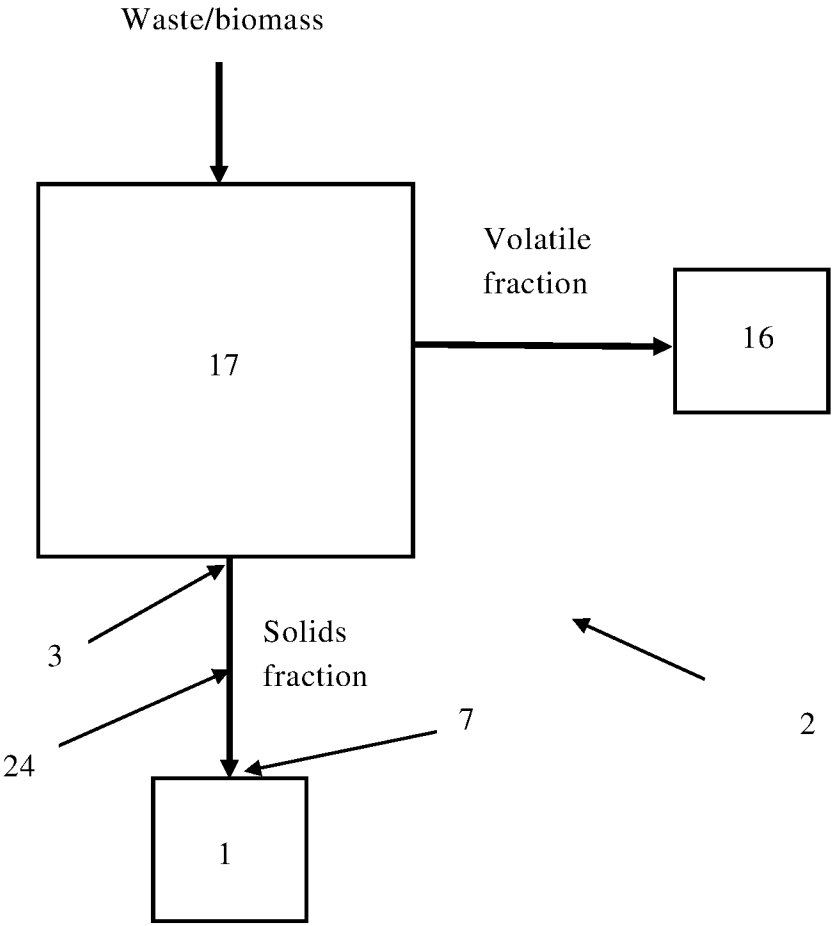
FIG. 1 is a schematic drawing of a pyrolysis system according to the invention.
Figure 2:
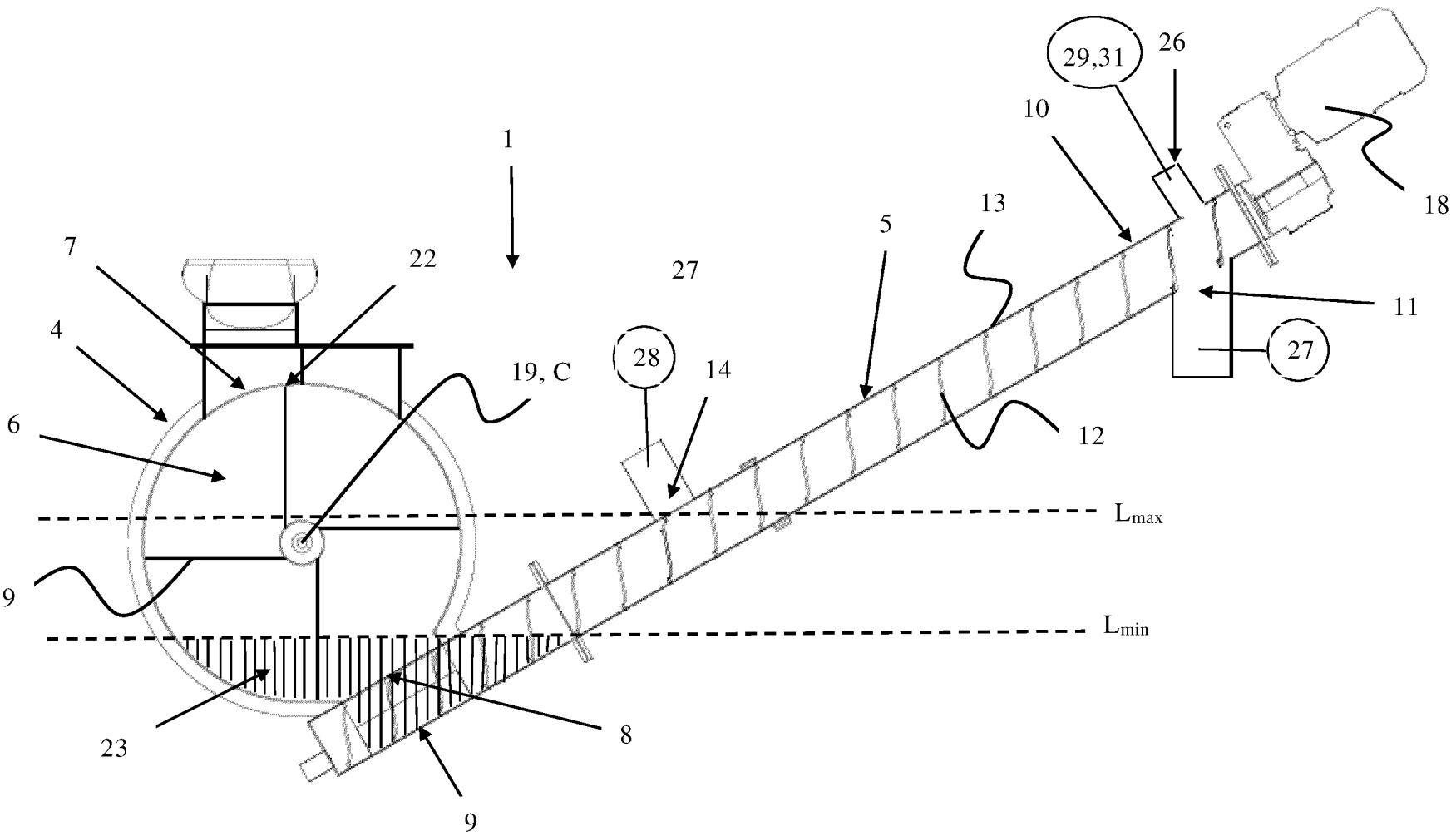
FIG. 2 is a cross-sectional side view of an exemplary char collector according to the invention.
Figure 3:
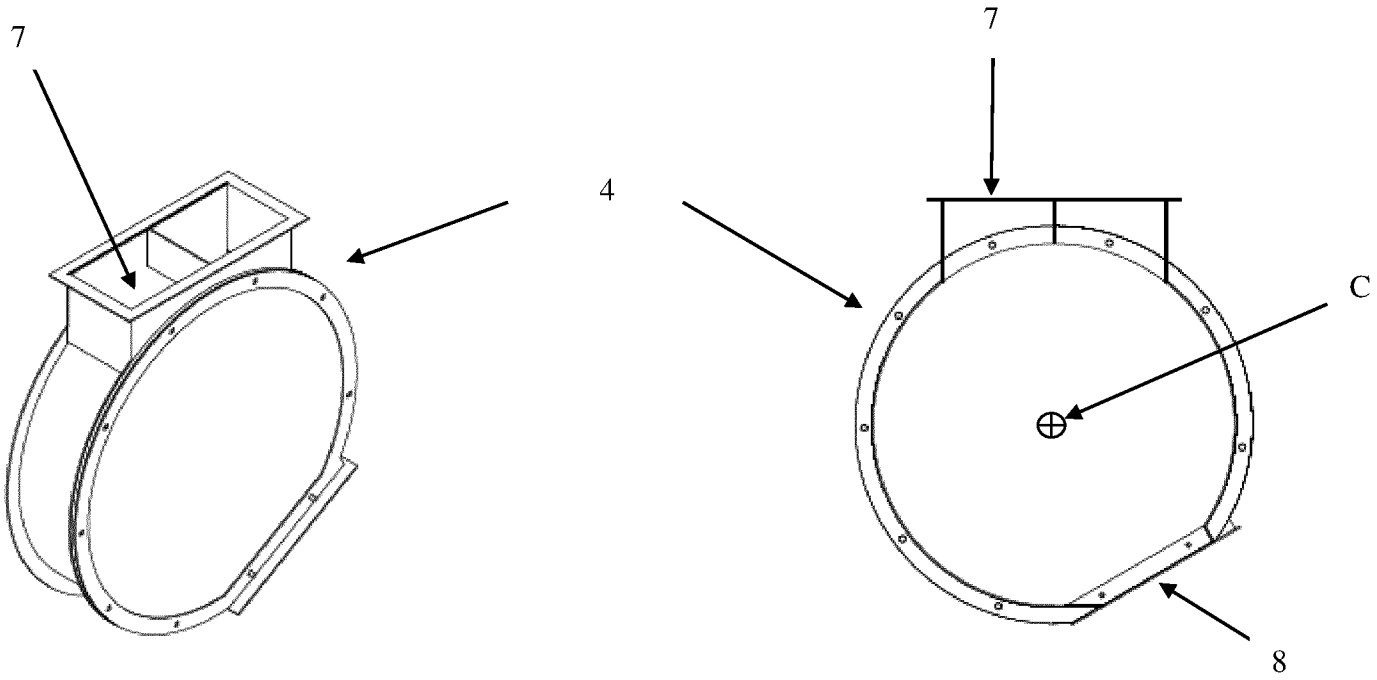
FIG. 3 is a side view and a perspective view of the container of the char collector in FIG. 2.
Figure 4:
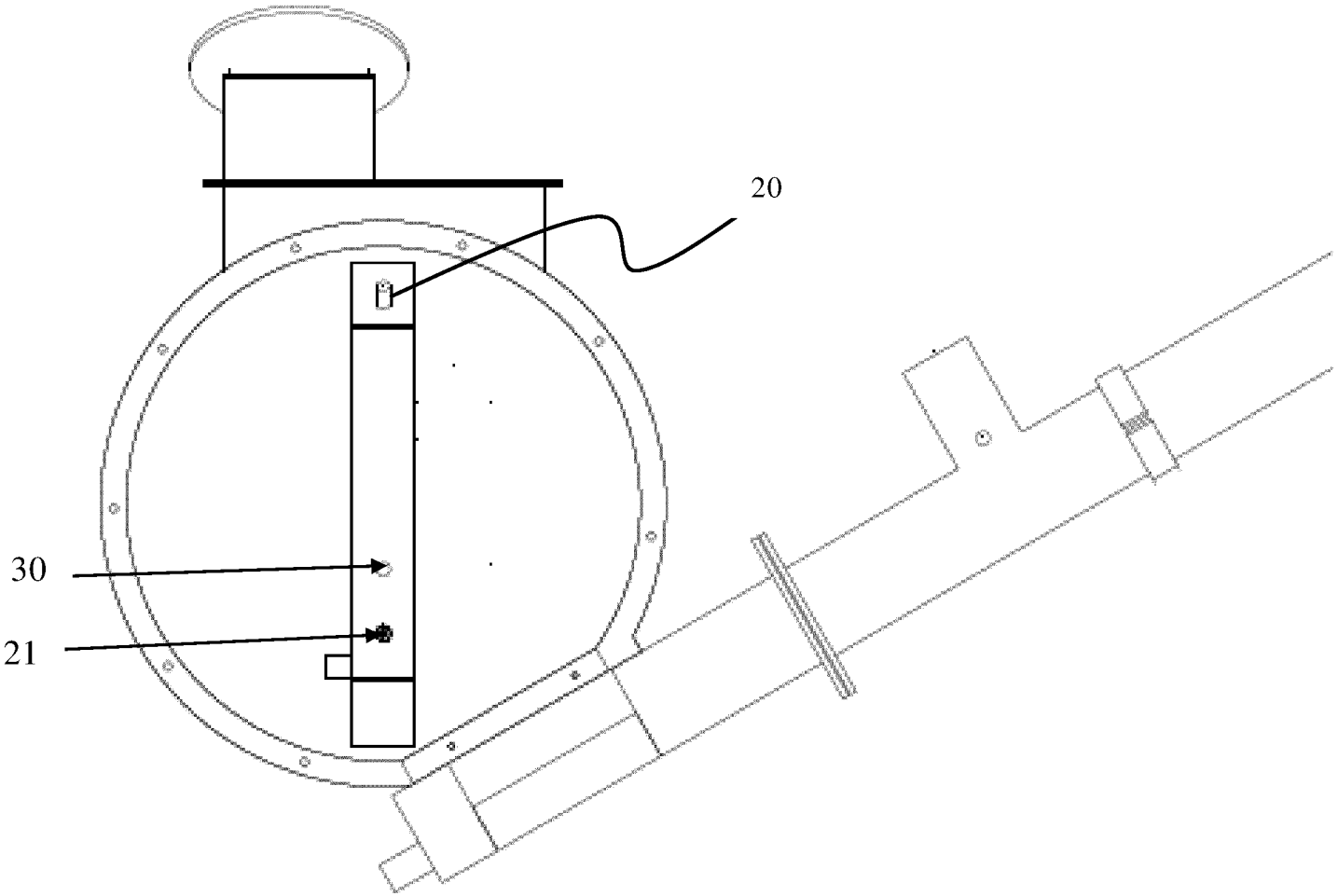
FIG. 4 is a side view of the char collector in FIG. 2.
Figure 5:
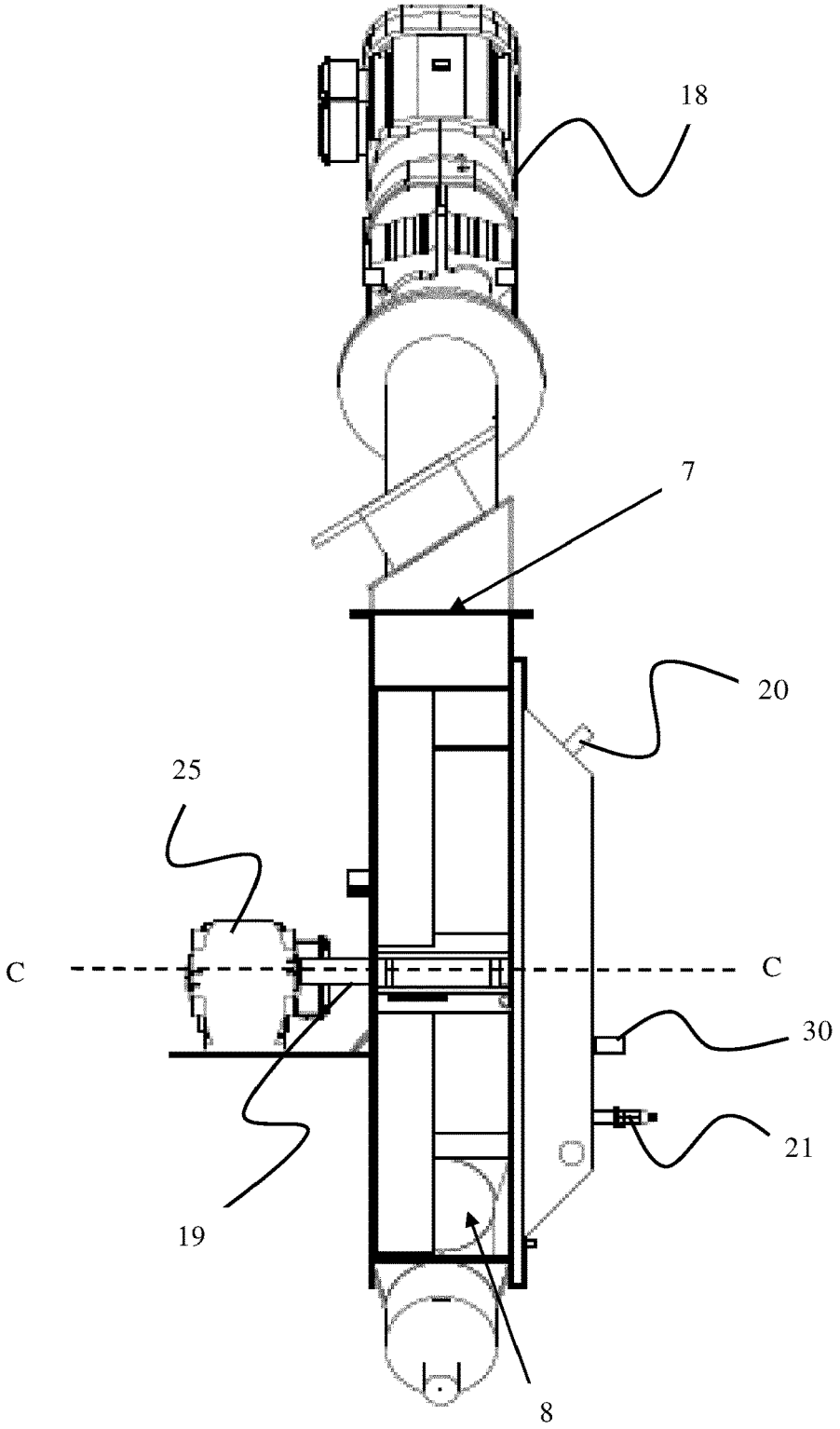
FIG. 5 is a cross-sectional front view of the char collector in FIG. 2.

A schematic drawing of a pyrolysis system 2 comprising a char collector 1 according to the invention is shown in FIG. 1. The main feature of the pyrolysis system 2 is a pyrolysis reactor 17. In the pyrolysis reactor 17, materials such as waste or biomass, are pyrolyzed into products that may be divided into a solids fraction, i.e. char, and a volatile fraction. The ratio and specific contents of the fractions depend on multiple variables such as the pyrolysis temperature, time, type of material being pyrolyzed etc. However, the solids fraction is predominantly char, while the volatile fractions may be mixtures of syngas ($CO,H_2$), tar and light hydrocarbons.

The volatile fractions are commonly further processed in a gas handling system 16 for separation, purification and/or storage of the mixture of products.

The char, i.e. the solids fractions, exits a hot char outlet 3 of the pyrolysis reactor 17 and enters a first inlet 7 of the char collector 1. The first inlet 7 is at least indirectly connected to the hot char outlet 3, such that char may be transferred from the pyrolysis reactor 17 to the first inlet 7. In some embodiments, the hot char outlet 3 may be connected to the first inlet 7 by a char transfer assembly 24 comprising e.g. a screw conveyor or similar. The hot char outlet 3 and the first inlet is always connected in a fluid tight manner, i.e. in a manner which prevents ambient air from contacting the char when transferred from the hot char outlet 3 to the first inlet 7.

The inventive char collector 1 may be used in connection with any type of pyrolysis system wherein a solids fraction of char is obtained. Examples of suitable pyrolysis systems and pyrolysis reactors are disclosed in e.g. US 2012/0043194 A1, CN103923673A and WO 2018/177997 A1.

An embodiment of a char collector 1 according to the invention is shown in FIGS. 2-5.

The char collector 1 features a container 4 and a screw conveyor 5 (i.e. a longitudinal char conveyor unit). The container 4 has a chamber 6, a first inlet 7 arranged in an upper portion of the chamber 6 and a first outlet 8 arranged in a lower portion of the chamber 6. The screw conveyor 5 features a first end section 9 connected to the first outlet 8, a second end section 10 featuring a second outlet 11 for cooled char, a tube element 13 and a helical screw 12 (i.e. a conveying mechanism) arranged within the tube element 13 and configured to transport char from the first end section 9 to the second end section 11 during use. The helical screw 12 may be driven by a motor 18. In alternative embodiments, the screw conveyor may be substituted by a belt or chain conveyor arranged within a longitudinal hollow element having a suitable cross-section, e.g. a rectangular cross-section.

The first inlet 7 is arranged such that char entering the chamber 6 may be transferred to the first outlet 8 and the first end section 9 by gravity. The first inlet 7 may be connected, directly or indirectly, to a hot char outlet 3 of any type of pyrolysis reactor or system, such that hot char may enter the chamber 6.

During use, the chamber 6 is filled with water up to a maximum level $L_{max}$ above a highest level of the first outlet 8, i.e. above a minimum level $L_{min}$, and below the level of the first inlet 7. A lowest level of the second outlet 11 is above the highest level of the first outlet 8, and preferably above a mid-level of the chamber 6. In this manner a gas trap 23 is formed between the first inlet 7 and the second outlet 11. The gas trap 23 formed by having water up to the minimum level $L_{min}$ is illustrated by the hatched section in FIG. 2. The screw conveyor 5 may also feature a third outlet 14 positioned between the first outlet 8 and the second outlet 11. The third outlet 14 is arranged such that air may be introduced to the screw conveyor 12 via the second outlet 11, or an air inlet 26, and exit via the third outlet 14, e.g. arranged at an upwards facing surface of the screw conveyor 5. In this manner, a significant portion of excess moisture may be removed from the char before it is collected via the second outlet 11. In addition to the moisture removed by the introduced air, the design and length of the screw conveyor will also have a large impact on the amount of moisture/water in the char. The maximum level $L_{max}$ of water in the chamber 6 may be defined as a lowest level of the third outlet, see FIG. 2. A separate air inlet 26 is not a required feature but facilitates the advantageous collection of char from the second outlet as described below.

A temperature sensor 27 is arranged at the second outlet 11 to measure the temperature of the char exiting the char collector 1. To control the temperature and moisture content of the char exiting the second outlet, the char collector features temperature and moisture sensors 28,29 arranged at both the air inlet 26 and the third outlet 14. A flow meter 31 may also be arranged at the air inlet 26. Preferably, the temperature of the char exiting the second outlet 11 is within the range of 50-80° C. and the moisture content within the range of 15-25 wt %. Char having a moisture content above 15 wt % will not spontaneously combust when mixed with oxygen/air. The temperature and moisture sensors 27,28,29 and the flow meter 31 may communicate with a control system. The control system may control the flow of air to obtain char having a desired temperature and moisture content. A moisture sensor may also be arranged to measure the moisture of the char exiting the second outlet 11.

A pyrolysis reaction is performed in an inert or at least oxygen free/depleted atmosphere. The gas trap is a highly advantageous feature of the char collector 1 since it removes the need for mechanical airlocks or a counterflow of expensive inert gas to prevent air/oxygen from entering the pyrolysis system and pyrolysis reactor when char is collected. Mechanical airlocks are often service intensive, vulnerable towards larger particles of non-pyrolyzed material (e.g. metal fragments and similar that may have been introduced unintentionally), char particles of larger sizes, clogging, as well as requiring control systems and actuators. The gas trap also allows for having a pressure slightly below ambient within the pyrolysis system and/or pyrolysis reactor. Below ambient pressure is present within some pyrolysis systems due to the use of suction to transfer the volatile fractions to a gas handling system.

To obtain an improved mixing of the hot char and water, as well as an improved movement of char from the first inlet 7 to the first outlet 8, the char collector 1 may feature multiple blades 9 arranged to rotate inside the chamber 6. The blades 9 are connected to a rotary shaft 19 and a motor 25 arranged to allow rotation of each blade 9 between a first position and a second position, wherein the blade 9 is at a higher level in the first position than in the second position. The rotary shaft 19 may be arranged at a centreline C of the chamber 6. The blade 9 is closer to the first inlet 7 in the first position than in the second position. In other words, during use, at least portions of the blade 9 may be above a water level in the chamber 6 when in the first position and at least portions of the blade 9 may be below the water level when in the second position. The blades 9 are not an essential part of the inventive char collector 1 but may be advantageous in particular when the throughput of char is high.

When char is transferred from the chamber 6 by the screw conveyor 5, water is gradually removed from the chamber 6, i.e. the water level is lowered. To ensure the water level is always above the minimum level $L_{min}$ and below the maximum level $L_{max}$, the container comprises a controllable water inlet 20 for providing water into the chamber 6 and a water level sensor 21 for measuring the water level inside the chamber 6. The water level sensor 21 communicates with the controllable water inlet 20 such that water is added to the chamber when the water level falls below a predetermined level. The controllable water inlet 20 is closed when the water level sensor 21 detects a maximum water level. The predetermined water level is above the minimum level $L_{min}$ to avoid any risk of air entering the chamber. As a further safety precaution, a water level switch 30 is arranged to prevent the water level from falling below the minimum level $L_{min}$. In an alternative embodiment of the char collector, a relatively constant water level may also be obtained in the chamber by having an overflow outlet arranged in the tube element 13. The overflow outlet may be arranged at a level corresponding to the maximum water level.

Figure 6:
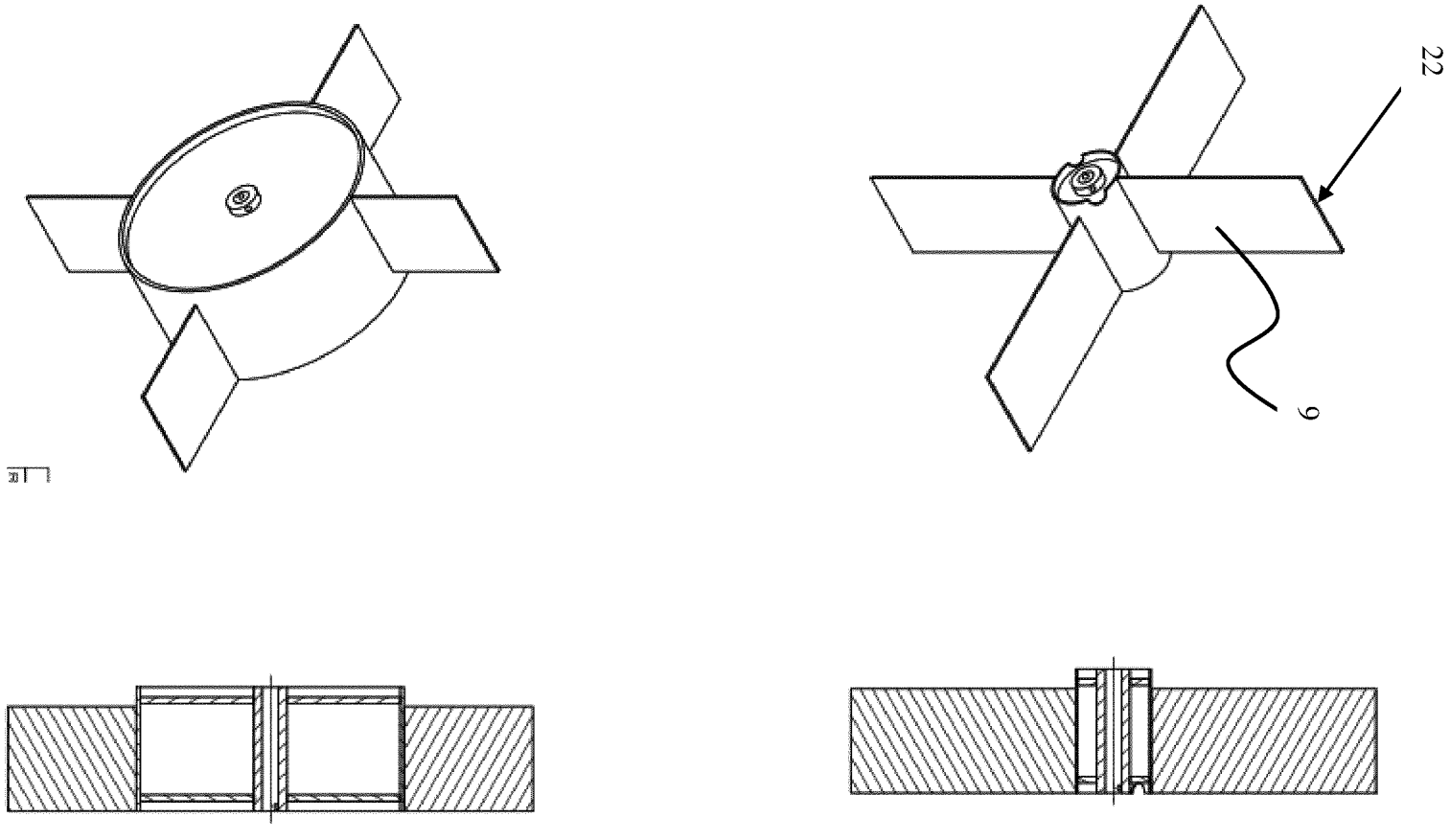
FIG. 6 show perspective views and cross-sectional views of alternative embodiments of a blade assembly for use in the char collector in FIG. 2.

In the illustrated embodiment of the char collector, the chamber is substantially cylinder-shaped and has a horizontal centre axis. The centreline of the rotary shaft 19 coincides with the centreline C of the chamber. In this manner the distal end 22 of each blade, i.e. the end being furthest from the rotary shaft 19, may move close to the substantially circular wall of the chamber during rotation of the blade. Having the blades 9 rotating around a horizontal centreline C of a cylinder-shaped chamber 6 is advantageous in that it contributes to an efficient movement of char from an upper portion of the chamber 6 to a lower portion of the chamber 6, and further to the first outlet 8 and into the first section 9 of the screw conveyor 5. Examples of alternative embodiments of blades 9 suitable for the char collector 1 are shown in FIG. 6. Although all disclosed embodiments feature four blades 9 evenly arranged around a rotary shaft 19, an advantageous movement and wetting of char may be obtained if at least one blade 9 is present in the chamber 6.

As mentioned above, the char exiting a pyrolysis reactor has a very high temperature and a significant portion of the char is finely divided particles and fines which are highly flammable and may spontaneously combust when mixed with oxygen/air. The inventive char collector will minimize or avoid the risk of handling the produced char, since the char exiting the second outlet 11 may be controlled to have a moisture content above 15 wt % and a temperature between 50-80° C.

The inventive char collector allows for a highly advantageous method of collecting char in fluid tight bags. In the method, char exiting the second outlet 11 may be loaded into a fluid tight bag which is then sealed while the temperature of the char is still at 50-80° C. Subsequent cooling of the char loaded into the bag provides moist char in a vacuum packaging. The fluid tight bag ensures that the char is kept at a sufficient moisture level to prevent combustion and may be handled without any extensive safety procedures.

Pyrolysis systems are often used in the disposal of waste materials, wherein the obtained products, e.g. char, oil and tar, are not necessarily the main goal of the pyrolysis process. However, the obtained products, as well as the heat energy produced in the process, are valuable and it is envisioned that the pyrolysis system and char collector may be used in processes wherein the obtained products and/or the produced heat energy are the main goal. Such processes may for instance be the production of biofuel by pyrolysis of wood-based raw materials, production of char, energy production and similar. Thus, the term pyrolysis system is intended to cover systems such as waste treatment systems, biofuel production systems and power plants.

The invention claimed is:

1. A char collector for a pyrolysis system, the pyrolysis system featuring a pyrolysis reactor comprising a hot char outlet, the char collector comprises a container and a longitudinal char conveyor unit, and the container comprises a chamber, a first inlet connectable to the hot char outlet and a first outlet, wherein the first inlet is arranged in an upper portion of the chamber and the first outlet is arranged in a lower portion of the chamber; and the char conveyor unit comprises a first end section connected to the first outlet, a second end section featuring a second outlet for cooled char and a conveying mechanism configured to transport char from the first end section to the second outlet during use;

wherein the second outlet is at a level above the first outlet, such that a gas trap is formed between the first inlet and the second outlet when the chamber is filled with water up to a level above the first outlet during use and wherein the char collector comprises at least one blade arranged to rotate inside the chamber, the blade is connected to a rotary shaft arranged to allow rotation of the blade between a first position and a second position, wherein at least a portion of the blade is above the water level in the chamber and under the first inlet when in the first position and the portion of the blade is below the water level when in the second position, the blade is configured to mix hot char, entering the container via the first inlet during use, into the water in the chamber.

2. A char collector according to claim 1, wherein the second outlet is at a level above a mid-level of the chamber.

3. A char collector according to claim 1, wherein the container comprises a controllable water inlet for providing water into the chamber and a water level sensor for measuring a water level inside the chamber, the water level sensor connected to the controllable water inlet, such that water is added to the chamber when the water level falls below a predetermined level.

4. A char collector according to claim 1, wherein the char conveyor unit comprises a longitudinal hollow element in which at least a lower section of the conveying mechanism is arranged.

5. A char collector according to claim 4, wherein the conveying mechanism is a helical screw and the longitudinal hollow element is a tube element.

6. A char collector according claim 1, wherein the char conveyor unit comprises a third outlet positioned between the first outlet and the second outlet, and a lowest level of the third outlet is above a highest level of the first outlet.

7. A char collector according to claim 6, wherein the longitudinal char conveyor unit comprises an air inlet arranged at a level above the third outlet.

8. A char collector according to claim 7, comprising sensors for measuring temperature, moisture and/or air flow, arranged at the second outlet, the third outlet and/or the air inlet.

9. A pyrolysis system comprising a pyrolysis reactor and a char collector according to claim 1, wherein the pyrolysis reactor comprises a hot char outlet connected to the first inlet of the char collector.

10. A method of collecting char from a pyrolysis reactor having a hot char outlet connected to the first inlet of a char collector according to claim 1, the method comprising the steps of:

providing water into the chamber to obtain a water level above the highest level of the first outlet;

transferring char from the hot char outlet to the chamber;

cooling the char by mixing with the water in the chamber;

transferring the char from the chamber to the second outlet via the first outlet and the char conveyor unit; and collecting the char from the second outlet.

11. A method according to claim 10, wherein the step of collecting the char from the second outlet comprises loading the char into a fluid tight bag which is subsequently sealed.

12. A method of controlling the moisture content of char collected from a pyrolysis reactor having a hot char outlet connected to the first inlet of a char collector according to claim 1, the method comprising the steps of:

introducing a relatively dry and cold air via the air inlet;

extracting a relatively moist and hot air via the third outlet;

determining the temperature and moisture of the char exiting the second outlet; and increasing the flow of air into the air inlet if the char has a moisture content above a predetermined level; or decreasing the flow of air into the air inlet if the char has a moisture content below a predetermined level.

* * * * *